US009675855B2

(12) United States Patent
Jones

(10) Patent No.: US 9,675,855 B2
(45) Date of Patent: Jun. 13, 2017

(54) DOUBLE ACTION GOLF PUTTER HEAD

(71) Applicant: Floyd B. Jones, El Cajon, CA (US)

(72) Inventor: Floyd B. Jones, El Cajon, CA (US)

( * ) Notice: Subject to any disclaimer, the term of this patent is extended or adjusted under 35 U.S.C. 154(b) by 0 days.

(21) Appl. No.: 14/919,624

(22) Filed: Oct. 21, 2015

(65) Prior Publication Data

US 2016/0114230 A1 Apr. 28, 2016

Related U.S. Application Data

(60) Provisional application No. 62/067,399, filed on Oct. 22, 2014.

(51) Int. Cl.
*A63B 53/04* (2015.01)

(52) U.S. Cl.
CPC .. *A63B 53/0487* (2013.01); *A63B 2053/0441* (2013.01); *A63B 2053/0495* (2013.01)

(58) Field of Classification Search
CPC ..... A63B 53/0487
See application file for complete search history.

(56) References Cited

U.S. PATENT DOCUMENTS 3,589,731 A * 6/1971 Chancellor, Jr. ..... A63B 53/08 473/333
6,171,204 B1 * 1/2001 Starry ..... A63B 53/06 473/256
6,872,148 B2 * 3/2005 Lee ..... A63B 53/0466 473/131
2006/0172816 A1 * 8/2006 Johnson ..... A63B 53/0487 473/334

* cited by examiner

*Primary Examiner* — Michael Dennis
(74) *Attorney, Agent, or Firm* — Richard D. Clarke

(57) ABSTRACT

The present invention is directed to a Double Action Golf Putter Head that when the putter strikes the golf ball the force causes a spring loaded weight to compress the forward spring in a secondary striking action to accelerate the forces against the golf ball along with an optional set of balance adjustment weights on the extensions on either side of the club head.

20 Claims, 4 Drawing Sheets

DOUBLE ACTION GOLF PUTTER HEAD

FIELD OF THE INVENTION

This application provides a Double Action Golf Putter Head that when the putter strikes the golf ball the force causes a spring loaded weight to compress the forward spring in a secondary striking action to accelerate the forces against the golf ball along with an optional set of balance adjustment weights on the extensions on either side of the club head.

BACKGROUND OF THE INVENTION

A putter is a club used in the sport of golf to make relatively short and low-speed strokes with the intention of rolling the ball into the cup from a short distance. It is differentiated flow the other clubs by a club head with a very flat, low-profile, low-loft striking face.

Putters are generally used from very close distances to the cup, generally on the putting green. While no club in a player's bag is absolutely indispensable the putter comes closest. It is a highly specialized tool for a specific job, and virtually no golfer is without one.

Putting is the most precise aspect of the game of golf. The putter must be designed to give the golfer every technical advantage including smooth stroke, good glide, sweet impact, and bounce-less topspin ball launch as well as every technique advantage including perfect fit as to shaft angle and length.

The design of the putter's club head has undergone radical change in the last 20-30 years. The putter was originally a forged iron piece very similar in shape to the irons of the day. The introduction of investment casting for club heads allowed drastically different shapes to be made far more easily and cheaply than with forging, resulting in many design improvements. First of all, the majority of mass behind the clubface was placed as low as possible, resulting in an L-shaped side profile with a thin, flat club face and another thin block along the bottom of the club behind the face. Additionally, peripheral weighting, or the placing of mass as far away from the center of the club face as possible, increases the moment of inertia of the club head, reducing twisting if the club contacts the ball slightly off-center and thus giving the club a larger "sweet spot" with which to contact the ball. Newer innovations include replacing the metal at the "sweet spot" with a softer metal or polymer compound that will give and rebound at impact, which increases the peak impulse (force×time) imparted to the ball for better distance.

Numerous innovations for the Double Action Golf Putter lead have been provided in the prior art that are described as follows. Even though these innovations may be suitable for the specific individual purposes to which they address, they differ from the present design as hereinafter contrasted. The following is a summary of those prior art patents most relevant to this application at hand, as well as a description outlining the difference between the features of the Double Action Golf Putter Head from the prior art.

US Patent Application Publication No. US 200410132542 A1 of Thomas Olsavsky describes a putter head having enhanced inertia and alignment characteristics. The putter head includes a front body and a weight body. The weight body includes a central weight extending rearwardly from the front body a prescribed distance to a rear weight. The putter head is configured such that the rear weight has a width less than the width of the from body and greater than a width of the central weight. Thus, both the longitudinal and lateral moments of inertia are improved to offer greater forgiveness and increased accuracy during putts. The central weight may include at least one and more preferably two elongated, high-density elements that are visible on a top surface of the sole between the front body and the rear weight. The visibility of the elongated elements, with optional parallel markings on the top surface, also act as alignment aids to the golfer.

This patent describes a putter head that is configured such that the rear weight has a width less than the width of the front body and greater than a width of the central weight. Thus, both the longitudinal and lateral moments of inertia are improved to offer greater forgiveness and increased accuracy during putting, but does not incorporate the unique feature that when the putter strikes the golf ball the force causes to spring loaded weight to compress the forward spring in a secondary striking action to accelerate the forces against the golf ball.

US Patent Application Publication No. US 200510227777 of Brian M. Cover et al. describes a putter with a head that includes a forward portion including a face for striking a golf ball and a wing portion extending rearward from the forward portion and movable between at least two operative positions, a first operative position, and a second operative position laterally displaced along the forward portion in a direction outwardly away from the proximate end of the shaft to alter the heel-to-toe weight distribution of the putter.

This patent describes a putter with a head that includes a forward portion including a face for striking a golf ball; and, a wing portion extending rearward from the forward portion and movable between at least two operative positions. This patent does not incorporate the unique feature that when the putter strikes the golf ball the force causes a spring loaded weight to compress the forward spring in a secondary striking action to accelerate the forces against the golf ball.

US Patent Application Publication No. US 2007/0129163 of Ray Solari describes a customizable putter that provides a platform having removable and adjustable weights. A customizable putter for golf is achieved by providing a platform with an embodiment having a vertical face portion and rearwardly extending flange portion attached to the bottom of the face portion. Weights may then be removably attached by threaded screws or bolts. The weights may have cavities within them into which weighted inserts may be fitted to provide further adjustment to the weight distribution and overall weight of the putter head. Such inserts, as well as the weight cavities, may take a variety of geometrical shapes and sizes.

This patent describes a customizable putter that provides a platform having removable and adjustable weights but does not Incorporate the unique feature that when the putter strikes the golf ball the force causes a spring loaded weight to compress the forward spring in a secondary striking action to accelerate the forces against the golf ball.

None of these previous efforts, however, provides the benefits attendant with the Double Action Golf Putter Head. The present design achieves its intended purposes objects and advantages over the prior art devices through a new, useful and unobvious combination of method steps and component elements, with the use of a minumum number of functioning parts, at a reasonable cost to manufacture, and by employing readily available materials.

SUMMARY OF THE INVENTION

The principle advantage of the preferred embodiment of the Double Action Golf Putter Head is the increased, additional forces on the golf ball at the time of impact with the putter head.

Another advantage of the preferred embodiment of the Double Action Golf Putter Head is the ability to adjust the forces on the golf ball at the time of impact with the putter head by changing the location of the adjustment setscrew modifying the forces on the spring loaded central weight segment.

Another advantage of the preferred embodiment of the Double Action Golf Putter Head is the ability to adjust the number and location of the balance weights on either side of putter head.

An advantage of the alternate embodiment of the Double Action Golf Putter is only having the centrally located adjustment setscrew for modifying the forces on the spring loaded central weight segment.

The Double Action Golf Putter Head with side extension has been designed so that when the putter strikes the golf ball the force causes a spring loaded weight to compress the forward spring in a secondary striking action to accelerate the forces against the golf ball. A threaded orifice at the rear extends into the club head central member where the front compression spring, spring loaded weight, the rear compression spring and adjustment set screw are located. The adjustment set screw is used to make minor adjustments on the preloading of the spring loaded weight.

On the preferred embodiment of the Double Action Golf Putter Head at either side of the club head central member are the club side extensions that have the balance adjustment mechanism with the threaded orifices and the threaded balance adjustment weights. One or two threaded balance adjustment weights are inserted within the threaded orifices and then moved forward or backward to adjust the desired balance of the club head on either side.

The alternate embodiment of the Double Action Golf Putter Head will have just the central weight mechanism where the threaded orifice at the rear extends into the club head central member with the front compression spring, spring loaded weight, the rear compression spring, and adjustment set screw.

With respect to the above description then, it is to be realized that the optimum dimensional relationships for the pans of this application, to include variations in size, materials, shape, form, function and manner of operation, assembly and use, are deemed readily apparent and obvious to one skilled in the art. All equivalent relationships to those illustrated in the drawings and described in the specification intend to be encompassed by the present disclosure. Therefore, the foregoing is considered as illustrative only of the principles of the Double Action Golf Putter Head. Further, since numerous modifications and changes will readily occur to those skilled in the art, it is not desired to limit the design to the exact construction and operation shown and described, and accordingly, all suitable modifications and equivalents lay be resorted to falling within the scope of this application.

BRIEF DESCRIPTION OF THE DRAWINGS

The accompanying drawings, which are incorporated in and form a part of this specification, illustrate embodiments of the Double Action Golf Putter Head and together with the description, serve to explain the principles of this application.

Figure 1:
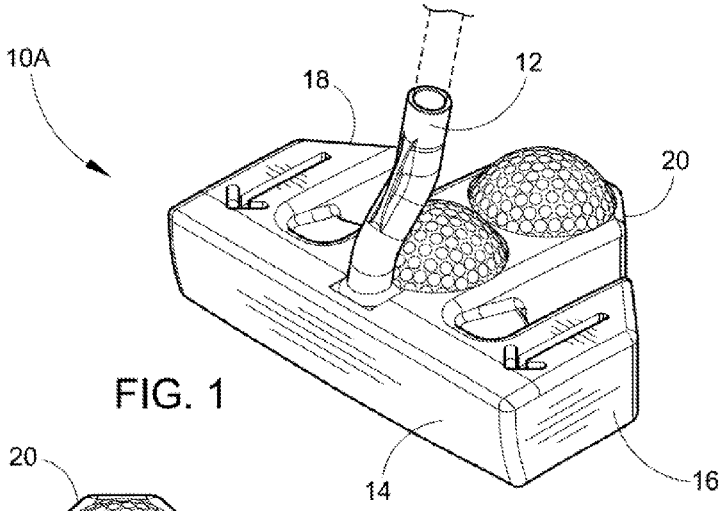
FIG. 1 depicts a perspective view of the Double Action Golf Putter Head.

For a fuller understanding of the nature and advantages of the Double Action Golf Putter Head and alternate embodiment of the Double. Action Golf Putter Head, reference should be had to the following detailed description taken in conjunction with the accompanying drawings which are incorporated in and form a pan of this specification, illustrate embodiments of the design and together with the description, serve to explain the principles of this application.

DETAILED DESCRIPTION OF THE PREFERRED EMBODIMENTS

Referring now to the drawings, wherein similar parts of the Double Action Golf Putter Head 10A and 10B are identified by like reference numerals, there is seen in 1 a perspective view of the Double Action Golf Putter Head 10A with the club shaft hosel 12 extending from above the club face 14 and the club head side extensions 16 and 18 on either side of the club head central member 20.

Figure 2:
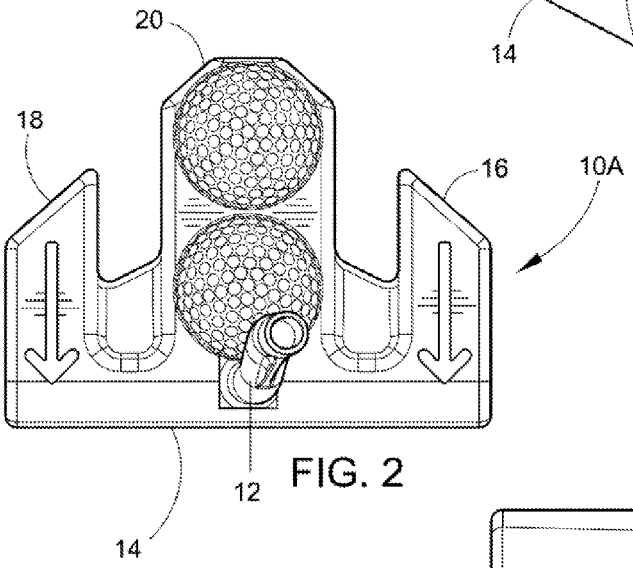
FIG. 2 depicts a top view of the Double Action Golf Putter Head.

FIG. 2 depicts a top view of the Double Action Golf Putter Head 10A with the club head side extensions 16 and 18 on either side of the club head central member 20.

Figure 3:
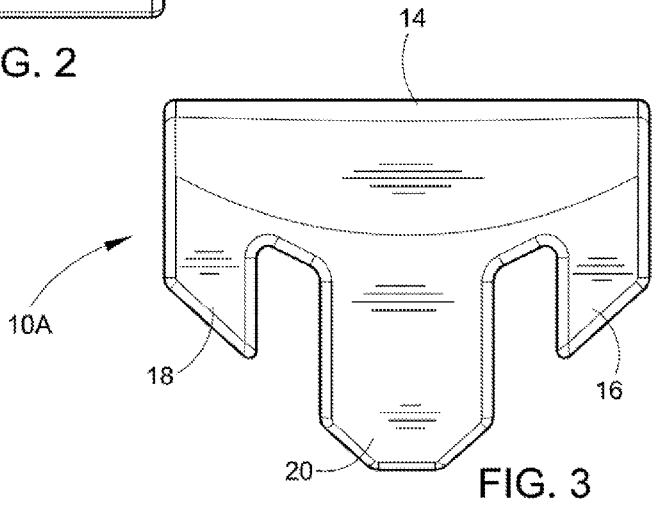
FIG. 3 depicts a bottom view of the Double Action Golf Putter Head

FIG. 3 depicts a bottom view of the Double Action Golf Putter Head 10A with the club head side extensions 16 and 18 on either side of the club central member 29.

Figure 4:
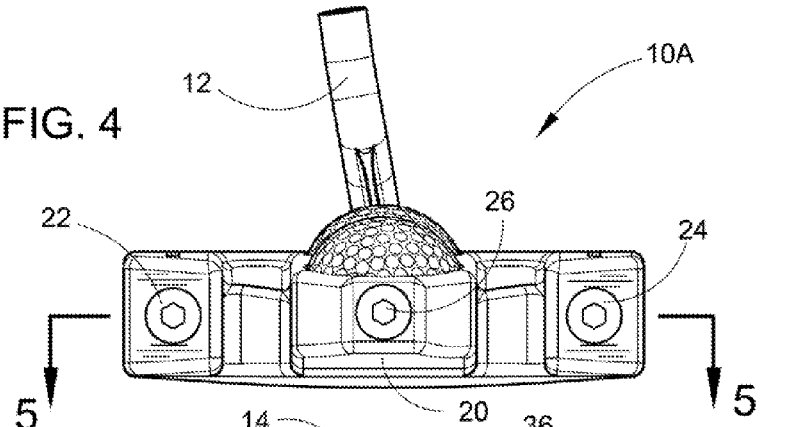
FIG. 4 depicts a rear view of the Double Action Golf Putter Head with balance adjustment mechanisms on either side.

FIG. 4 depicts a rear view of the Double Action Golf Putter Head 10A with balance adjustment mechanisms 22 and 24 on either side.

Figure 5:
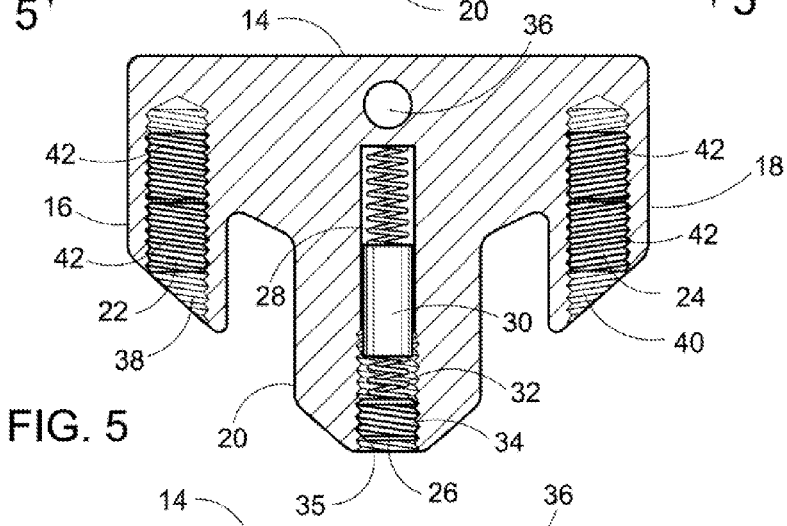
FIG. 5 depicts a horizontal cross section through the Double Action Golf Putter Head exposing the spring loaded central weight mechanism and a balance adjustment mechanisms on each side.

FIG. 5 depicts a horizontal cross section through the Double Action Golf Putter Head 10A exposing the spring loaded central weight mechanism 26 consisting of the front compression spring 28, spring loaded central weight segment 30, the rear compression spring 32 and the adjustment setscrew 34 in the central threaded orifice 35. The shaft mounting orifice 36 is centrally located adjacent to the club face 14. On either side of the club head central member 20 are the club head side extensions 16 and 18 that have the balance adjustment mechanisms 22 and 24 with the threaded orifices 38 and 40 housing the threaded balance adjustment weights 42.

Figure 6:
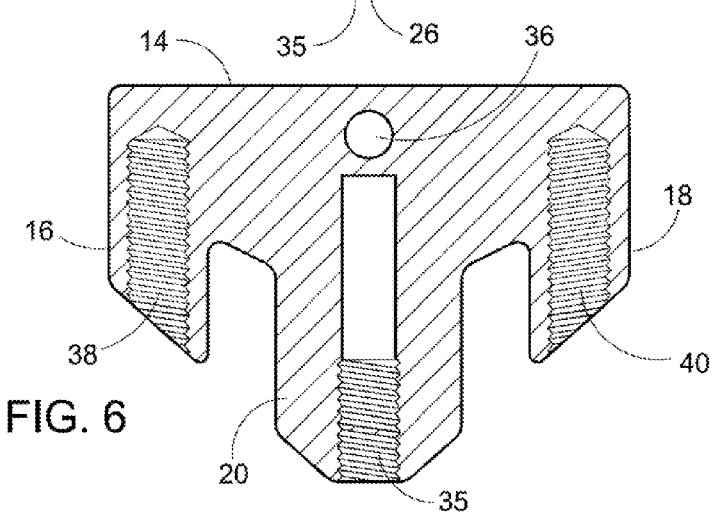
FIG. 6 depicts a horizontal cross section through the Double Action Golf Putter Head with the internal mechanisms removed.

FIG. 6 depicts a horizontal cross section through the Double Action Golf Putter Head with the internal mechanisms removed displaying the central threaded orifice 3 in the club head central member 20 and the threaded orifices 38 and 40 in the club head side extensions 16 and 18.

Figure 7:
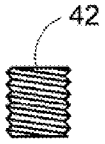
FIG. 7 depicts a single threaded balance adjustment weight segment.

FIG. 7 depicts a single threaded balance adjustment weight 42.

Figure 8:
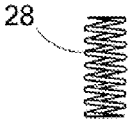
FIG. 8 depicts the front compression spring.

FIG. 8 depicts the front compression spring 28.

Figure 9:
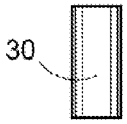
FIG. 9 depicts the spring loaded central weight segment.

FIG. 9 depicts the spring loaded central weight segment 30.

Figure 10:
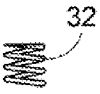
FIG. 10 depicts the rear compression spring.

FIG. 10 depicts the rear compression spring 32.

Figure 11:
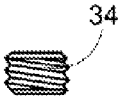
FIG. 11 depicts the adjustment setscrew.

FIG. 11 depicts the adjustment setscrew 34.

Figure 12:
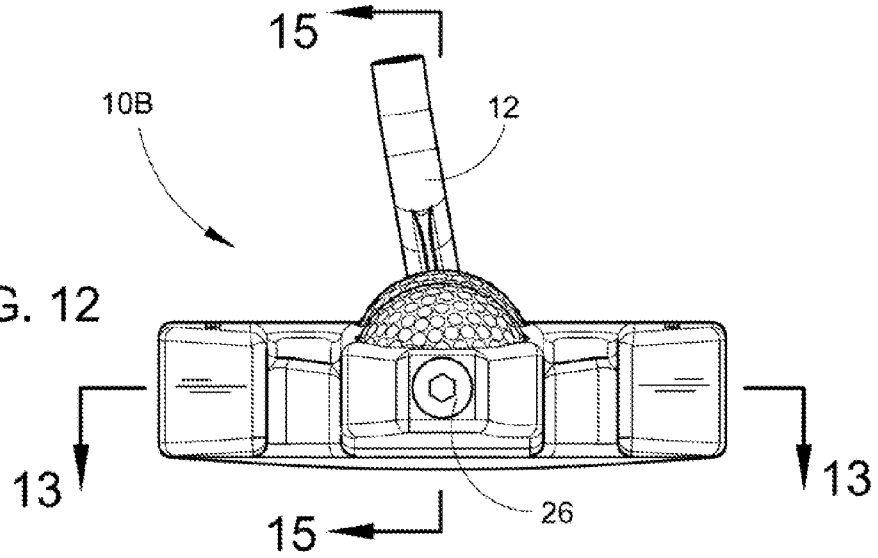
FIG. 12 depicts a rear view of the alternate embodiment of the Double Action Golf Putter Head with a spring loaded central weight mechanism.

FIG. 12 depicts a rear view of the alternate embodiment of the Double Action Golf Putter Head 108 with a spring loaded central weight mechanism 26.

Figure 13:
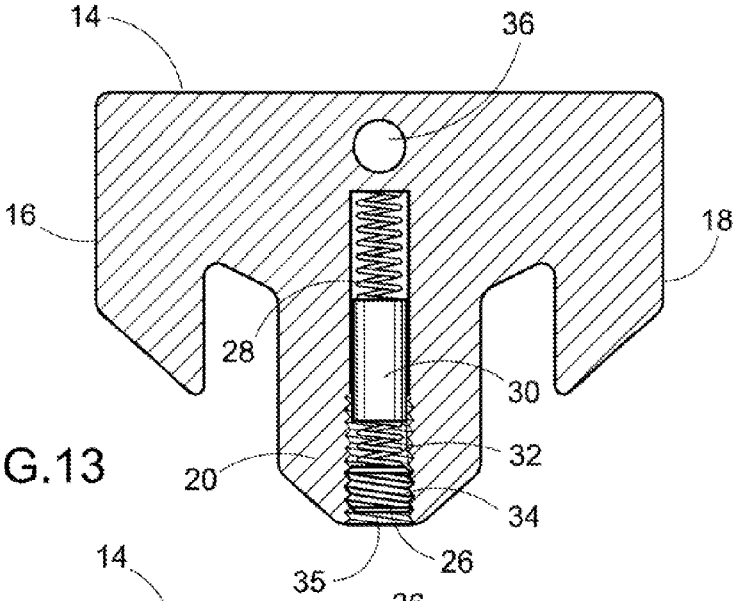
FIG. 13 depicts a horizontal cross section through the alternate embodiment of the Double Action Golf Putter Head exposing the spring loaded central weight mechanism.

FIG. 13 depicts a horizontal cross section through the alternate embodiment of the Double Action Golf Putter Head 10B exposing the spring loaded central weight mechanism 30.

Figure 14:
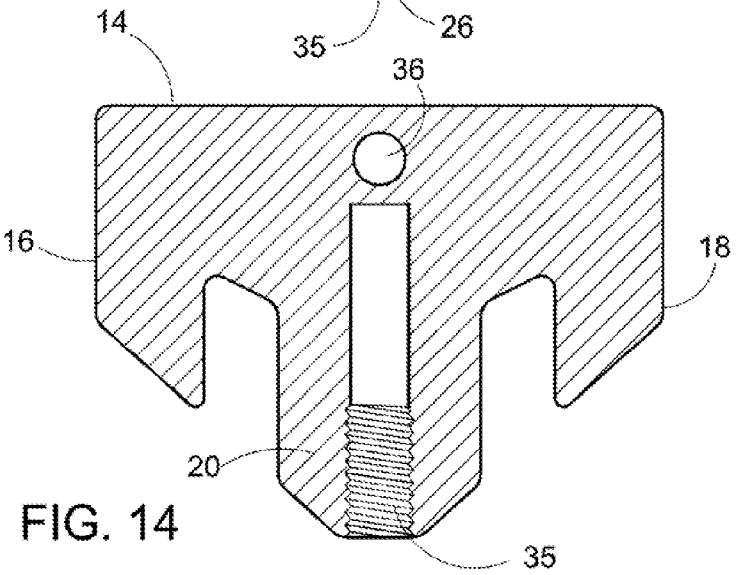
FIG. 14 depicts a horizontal cross section through the alternate embodiment of the Double Action Golf Putter Head with the internal mechanisms removed.

FIG. 14 depicts a horizontal cross section through the alternate embodiment of the Double Action Golf Putter Head 10B with the internal mechanisms removed displaying central threaded orifice 35 in the dub head central member 20.

Figure 15:
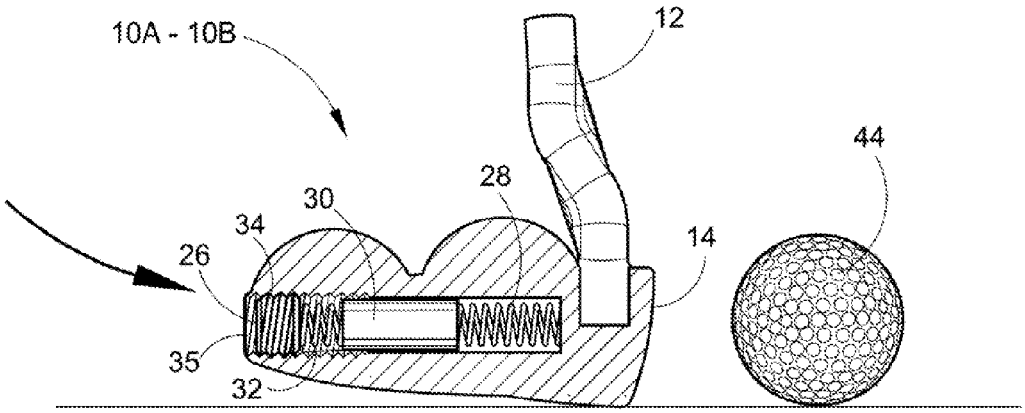
FIG. 15 depicts a vertical cross section through the center of the Double Action Golf Putter Head and alternate embodiment of the Double Action Golf Putter Head in the forward stroke illustrating the location of the front compression spring, spring loaded central weight segment, the rear compression spring and the adjustment setscrew.

FIG. 15 depicts a vertical cross section through the center of the Double Action Golf Putter Head 10A and alternate embodiment of the Double Action Golf Putter Head 10B illustrating the location of the front compression spring 28, spring loaded central weight segment 30, the rear compression spring 32 and the adjustment setscrew 34 in the forward stroke before striking the golf ball 44.

Figure 16:
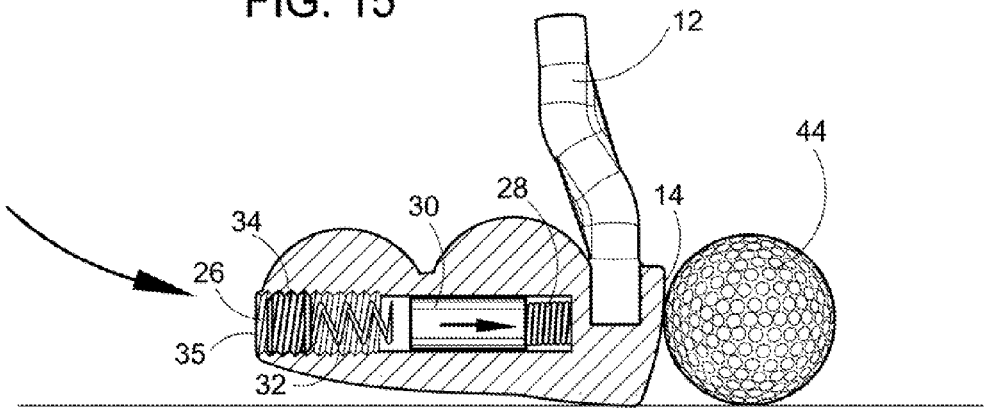
FIG. 16 depicts a vertical cross section through the center of the Double Action Golf Putter Head and alternate embodiment of the Double Action Golf Putter Head illustrating the location of the front compression spring being compressed when the spring loaded central weight segment is driven forward by the impact of the Double Action Golf Putter Head striking the golf ball in the forward stroke.

FIG. 16 depicts a vertical cross section through the center of the Double Action Golf Putter Head 10A and alternate embodiment of the Double Action Golf Putter Head 10B illustrating the location of the from compression spring 28 being compressed when the spring loaded central weight segment 30 is driven forward by the impact of the club face 14 striking the golf ball 44 in the forward stroke.

Figure 17:
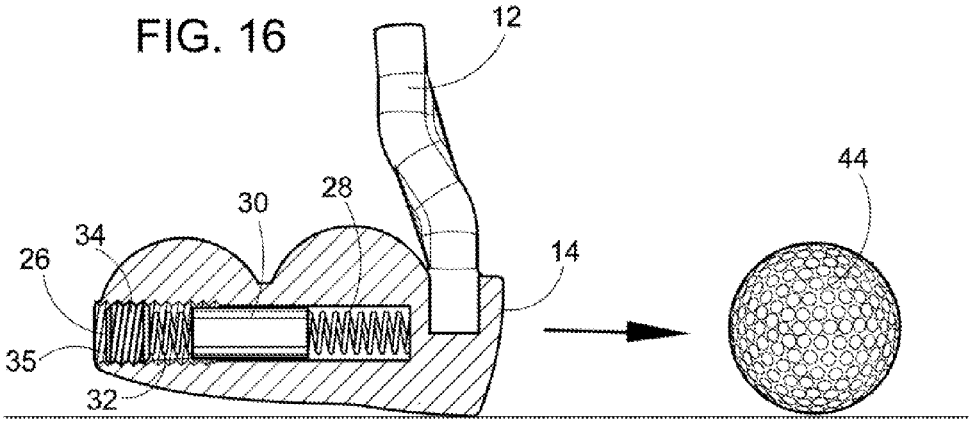
FIG. 17 depicts a vertical cross section through the center of the Double Action Golf Putter Head and alternate embodiment of the Double Action Golf Putter Head illustrating, the location of the front compression spring extending after the impact with the golf hall returning the spring loaded central weight segment back against the rear compression spring and the adjustment setscrew.

FIG. 17 depicts a vertical cross section through the center of the Double Action Golf Putter Head 10A and alternate embodiment of the Double Action Golf Putter Head 10B illustrating the location of the front compression spring 28 extending after the impact with the golf ball 44 returning the spring loaded central weight segment 30 back against the rear compression spring 32 and the adjustment setscrew 34.

The Double Action Golf Putter Head 10A and 10B shown in the drawings and described in detail herein may be constructed of thermoplastic and or composite polymer materials, such as Acrylonitrile butadiene styrene (ABS). Preferably, the Double Action Golf Putter Head will be made from ABS. The springs, cylinder weights, setscrews and balance adjustment weights will be made from steel, such as stainless steel, and other metals with relatively higher densities than thermoplastic and composite materials.

The Double Action Golf Putter Head 10A and 10B shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing the Double Action Golf Putter Head 10A and 108 in accordance with the spirit of this disclosure, and such changes, alternations and modifications as would occur to those skilled in the art are considered to be within the scope of this design as broadly defined in the appended claims.

Further, the purpose of the foregoing abstract is to enable the U.S. Patent and Trademark Office and the public generally, and especially the scientists, engineers and practitioners in the an who are not familiar with patent or legal terms or phraseology, to determine quickly from a cursory inspection the nature and essence of the technical disclosure of the Double Action Golf Putter Head application. The abstract is neither intended to define the invention of the application, which is measured by the claims, nor is it intended to be limiting as to the scope of the invention in any way.

I claim:

1. A double action golf putter head comprising:

(a) a putter head having a front impact surface and a rear surface;

(b) a centrally located bore within said putter head having a threaded orifice within said putter head rear surface;

(c) one or more springs, and a spring loaded central weight comprising a moveable cylinder weight located within said central bore;

(d) one or more set screws to secure said one or more springs, and said cylinder weight located within said central bore, further wherein the position of said spring loaded central weight is adjustable by adjustment of said set screws thereby modifying the forces on said spring loaded central weight, and resulting in the ability to adjust the forces on the golf ball at the time of impact with the putter; and (e) further wherein said putter head includes two club head side extensions located laterally to the left and right of said centrally located bore, for the purpose of housing balance adjustment weights;

wherein upon impact of said putter head front impact surface with a golf ball, said cylinder weight moves toward said front impact surface compressing said one or more springs, thereby creating a double action momentum swing and a secondary striking action to accelerate and increase the forces against the golf ball.

2. The double action golf putter head according to claim 1, wherein said putter head rear surface includes two club head side extensions further wherein each side extension includes central hollow portions.

3. The double action golf putter head according to claim 2, wherein said two club head side extensions include threaded orifices within said hollow portions.

4. The double action golf putter head according to claim 3, wherein said club head side extension threaded orifices accept one or more balance adjustment weights.

5. The double action golf putter head according to claim 4, wherein said one or more balance adjustment weights includes one or more threaded balance adjustment weights.

6. The double action golf putter head according to claim 1, wherein said one or more springs includes two springs and said two springs are located one spring in front of and one spring behind said cylinder weight.

7. The double action golf putter head according to claim 1, wherein said springs include springs having varying compression characteristics.

8. The double action golf putter head according to claim 1, wherein said cylinder weight includes cylinder weights of varying mass.

9. The double action golf putter head according to claim 1, wherein said putter head front impact surface is angled to generate backspin on the golf ball when a golf ball is struck.

10. The double action golf putter head according to claim 2, wherein said side extensions have arrows molded therein to help with aligning a putt.

11. A method for making a double action golf putter head comprising the steps of:

(a) providing a putter head having a front impact surface and a rear surface;

(b) providing a centrally located bore within said putter head having a threaded orifice within said putter head rear surface;

(c) providing one or more springs, and a spring loaded central weight comprising a moveable cylinder weight located within said central bore;

(d) providing one or more set screws to secure said one or more springs, and said cylinder weight located within said central bore, further wherein the position of said spring loaded central weight is adjustable by adjustment of said set screws thereby modifying the forces on said spring loaded central weight, and resulting in the ability to adjust the forces on the golf ball at the time of impact with the putter; and (e) further wherein said putter head includes two club head side extensions located laterally to the left and right of said centrally located bore, for the purpose of housing balance adjustment weights;

wherein upon impact of said putter head front impact surface with a golf ball, said cylinder weight moves toward said front impact surface compressing said one or more springs, thereby creating a double action momentum swing and a secondary striking action to accelerate and increase the forces against the golf ball.

12. The method of making a double action golf putter head according to claim 11, wherein said putter head rear surface includes two club head side extensions further wherein each side extension includes central hollow portions.

13. The method of making a double action golf putter bead according to claim 12, wherein said two club head side extensions include threaded orifices within said hollow portions.

14. The method of making a double action golf putter head according to claim 13, wherein said club head side extension threaded orifices accept one or more balance adjustment weights.

15. The method of making a double action golf putter head according to claim 14, wherein said one or more balance adjustment weights includes one or more threaded balance adjustment weights.

16. The method of making a double action golf putter head according to claim 11, wherein said one or more springs includes two springs and said two springs are located one spring in front of and one spring behind said cylinder weight.

17. The method of making a double action golf putter head according to claim 11, wherein said springs include springs having varying compression characteristics.

18. The method of making a double action golf putter head according to claim 11, wherein said cylinder weight includes cylinder weights of varying mass.

19. The method of making a double action golf putter head according to claim 11, wherein said putter head front impact surface is angled to generate backspin on the golf ball when a golf ball is struck.

20. The method of making a double action golf putter head according to claim 12, wherein said side extensions have arrows molded therein to help with aligning a putt.

* * * * *